US009572216B1

(12) United States Patent
Lee et al.

(10) Patent No.: US 9,572,216 B1
(45) Date of Patent: Feb. 14, 2017

(54) LIGHT SOURCE APPARATUS, DISPLAY APPARATUS INCLUDING THE SAME AND METHOD OF DRIVING THE SAME

(71) Applicant: Samsung Display Co., LTD., Yongin-si, Gyeonggi-Do (KR)

(72) Inventors: Dae-Sik Lee, Hwaseong-si (KR); Tae-Gon Im, Gwangmyeong-si (KR); Jin-Won Jang, Asan-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 15/004,903

(22) Filed: Jan. 23, 2016

(30) Foreign Application Priority Data

Jul. 29, 2015 (KR) ..... 10-2015-0107249

(51) Int. Cl.
*G09G 3/36* (2006.01)
*H05B 33/08* (2006.01)
*G09G 3/34* (2006.01)

(52) U.S. Cl.
CPC ..... *H05B 33/0845* (2013.01); *G09G 3/3406* (2013.01); *H05B 33/0818* (2013.01); *G09G 2320/0653* (2013.01)

(58) Field of Classification Search
CPC ..... G09G 3/3406
USPC ..... 345/102; 315/169.2, 169.3, 209 R, 291
See application file for complete search history.

(56) References Cited

U.S. PATENT DOCUMENTS 6,445,143 B1 * 9/2002 Min ..... G09G 3/3406 315/307
8,653,735 B2 * 2/2014 Wei ..... H05B 41/2855 315/121
8,692,760 B2 * 4/2014 Kang ..... G09G 3/3406 345/102
2008/0055232 A1 * 3/2008 Song ..... G09G 3/3406 345/102
2011/0069095 A1 * 3/2011 Kim ..... G09G 3/342 345/690

FOREIGN PATENT DOCUMENTS

KR 1020160130077 A 11/2016

* cited by examiner

*Primary Examiner* — Thuy Vinh Tran
(74) *Attorney, Agent, or Firm* — Cantor Colburn, LLP

(57) ABSTRACT

A light source apparatus includes a light source which emits light, a response improving part which generates a response improving signal based on a first dimming control signal having a first rising period, a first operation part which generate a second dimming control signal which has the first rising period based on the first dimming control signal, a second operation part which generates a third dimming control signal by performing an arithmetic operation based on the second dimming control signal and the response improving signal, the third dimming control signal having a second rising period shorter than the first rising period and a light source driver which generates a light source driving signal based on the third dimming control signal to drive the light source based on the light source driving signal.

20 Claims, 9 Drawing Sheets

LIGHT SOURCE APPARATUS, DISPLAY APPARATUS INCLUDING THE SAME AND METHOD OF DRIVING THE SAME

This application claims priority to Korean Patent Application No. 10-2015-0107249, filed on Jul. 29, 2015, and all the benefits accruing therefrom under 35 U.S.C. §119, the content of which in its entirety is herein incorporated by reference.

BACKGROUND

1. Field

Exemplary embodiments of the invention relate generally to display devices, and more particularly to light source apparatuses, display apparatuses including the light source apparatuses and methods of driving the light source apparatuses.

2. Description of the Related Art

Generally, it is desirable to provide a liquid crystal display ("LCD") apparatus with a relatively small thickness, a relatively light weight and a relatively low power consumption so that the LCD apparatus can be broadly used for mobile and other applications such as for a monitor, a laptop computer, a cellular phone, a television and so on. The typical LCD apparatus includes an LCD panel configured for displaying an image using a light transmittance characteristic of a liquid crystal and using a light source apparatus providing a light to the LCD panel. The light source apparatus may be a backlighting assembly that provides light to a back side of the LCD panel, for example.

The light source apparatus typically includes a plurality of light sources generating a light required to display an image on the LCD panel. The light sources may include at least one of a cold cathode fluorescent lamp ("CCFL"), an external electrode fluorescent lamp ("EEFL"), a flat fluorescent lamp ("FFL"), and one or more light emitting diodes ("LEDs"), for example.

Recently, LED's having a relatively low power consumption and those being eco-friendly has been developed. The typical light source apparatus therefore includes a string of LEDs connected for example in series with each other, and an LED driver configured for driving the LED string.

A brightness of the light source may be controlled by a dimming method. The dimming method may be an analogue dimming or a pulse width modulation ("PWM") dimming, for example.

SUMMARY

According to the analogue dimming, noise occurs less than the pulse width modulation ("PWM") dimming, but response speed is lower than the PWM dimming.

Exemplary embodiments of the invention provide a light source apparatus capable of improving display quality.

Exemplary embodiments of the invention provide a display apparatus including the light source apparatus.

Exemplary embodiments of the invention provide a method of driving the light source apparatus.

A light source apparatus according to an exemplary embodiment of the invention includes a light source, a response improving part, a first operation part, a second operation part and a light source driver. The light source emits light. The response improving part generates a response improving signal based on a first dimming control signal having a first rising period. The first operation part generates a second dimming control signal based on the first dimming control signal, the second dimming control signal having the first rising period. The second operation part generates a third dimming control signal by performing an arithmetic operation based on the second dimming control signal and the response improving signal, the third dimming control signal having a second rising period shorter than the first rising period. The light source driver generates a light source driving signal based on the third dimming control signal to drive the light source based on the light source driving signal.

In an exemplary embodiment, each of the first and second dimming control signals may have a first falling period, and the third dimming control signal may have a second falling period shorter than the first falling period.

In an exemplary embodiment, the response improving signal may have a positive voltage during the first rising period, and may have a negative voltage during the first falling period.

In an exemplary embodiment, the response improving part may include a capacitor including a first electrode connected to an input terminal of the response improving part and a second electrode connected to an output terminal of the response improving part, the input terminal receiving the first dimming control signal.

In an exemplary embodiment, the response improving part may further include a comparison part delivering the first dimming control signal to the capacitor only when a voltage variation of the first dimming control signal during the first rising period is greater than a reference variation.

In an exemplary embodiment, the comparison part may include a comparator including a first input terminal which receives the voltage variation, a second input terminal which receives the reference variation, and a comparator output terminal, and a switching element connected between the input terminal of the response improving part and the first electrode of the capacitor, and including a gate electrode connected to the comparator output terminal.

In an exemplary embodiment, the response improving part may further include a voltage limiter which sets upper and lower limits of the response improving signal, and connected between the second electrode of the capacitor and the output terminal of the response improving part.

In an exemplary embodiment, the second operation part may add the second dimming control signal to the response improving signal to generate the third dimming control signal.

In an exemplary embodiment, a duty ratio of the light source driving signal may be set based on a level of the third dimming control signal.

A display apparatus according to an exemplary embodiment of the invention includes a display panel and a light source apparatus. The display panel displays an image. The light source apparatus comprises a light source, a response improving part, a first operation part, a second operation part and a light source driver. The light source emits light to the display panel. The response improving part generates a response improving signal based on a first dimming control signal having a first rising period. The first operation part generates a second dimming control signal based on the first dimming control signal, the second dimming control signal having the first rising period. The second operation part generates a third dimming control signal by performing an arithmetic operation based on the second dimming control signal and the response improving signal, the third dimming control signal having a second rising period shorter than the first rising period. The light source driver generates a light source driving signal based on the third dimming control signal to drive the light source based on the light source driving signal.

In an exemplary embodiment, each of the first and second dimming control signals may have a first falling period, and the third dimming control signal may have a second falling period shorter than the first falling period.

In an exemplary embodiment, the response improving signal may have a positive voltage during the first rising period, and may have a negative voltage during the first falling period.

In an exemplary embodiment, the response improving part may include a capacitor including a first electrode connected to an input terminal of the response improving part and a second electrode connected to an output terminal of the response improving part, the input terminal receiving the first dimming control signal.

In an exemplary embodiment, the response improving part may further include a comparison part which delivers the first dimming control signal to the capacitor only when a voltage variation of the first dimming control signal during the first rising period is greater than a reference variation.

In an exemplary embodiment, the comparison part may include a comparator including a first input terminal which receives the voltage variation, a second input terminal which receives the reference variation, and a comparator output terminal, and a switching element connected between the input terminal of the response improving part and the first electrode of the capacitor, and including a gate electrode connected to the comparator output terminal.

In an exemplary embodiment, the response improving part may further include a voltage limiter which sets upper and lower limits of the response improving signal, and connected between the second electrode of the capacitor and the output terminal of the response improving part.

In an exemplary embodiment, the second operation part may add the second dimming control signal to the response improving signal to generate the third dimming control signal.

In an exemplary embodiment, a duty ratio of the light source driving signal may be set based on a level of the third dimming control signal.

A method of driving a light source apparatus according to an exemplary embodiment of the invention includes generating a response improving signal based on a first dimming control signal having a first rising period, generating a second dimming control signal based on the first dimming control signal, the second dimming control signal having the first rising period, generating a third dimming control signal by performing an arithmetic operation based on the second dimming control signal and the response improving signal, the third dimming control signal having a second rising period shorter than the first rising period, generating a light source driving signal based on the third dimming control signal, and emitting light based on the light source driving signal.

In an exemplary embodiment, generating the third dimming control signal may include adding the second dimming control signal to the response improving signal.

According to exemplary embodiments, a light source driving signal is generated by performing an arithmetic operation based on dimming control signals in an analogue dimming to improve response speed. Thus, display quality of the display apparatus can be improved.

BRIEF DESCRIPTION OF THE DRAWINGS

The above and other features and advantages of the invention will become more apparent by describing in detailed exemplary embodiments thereof with reference to the accompanying drawings, in which.

DETAILED DESCRIPTION

Figure 1:
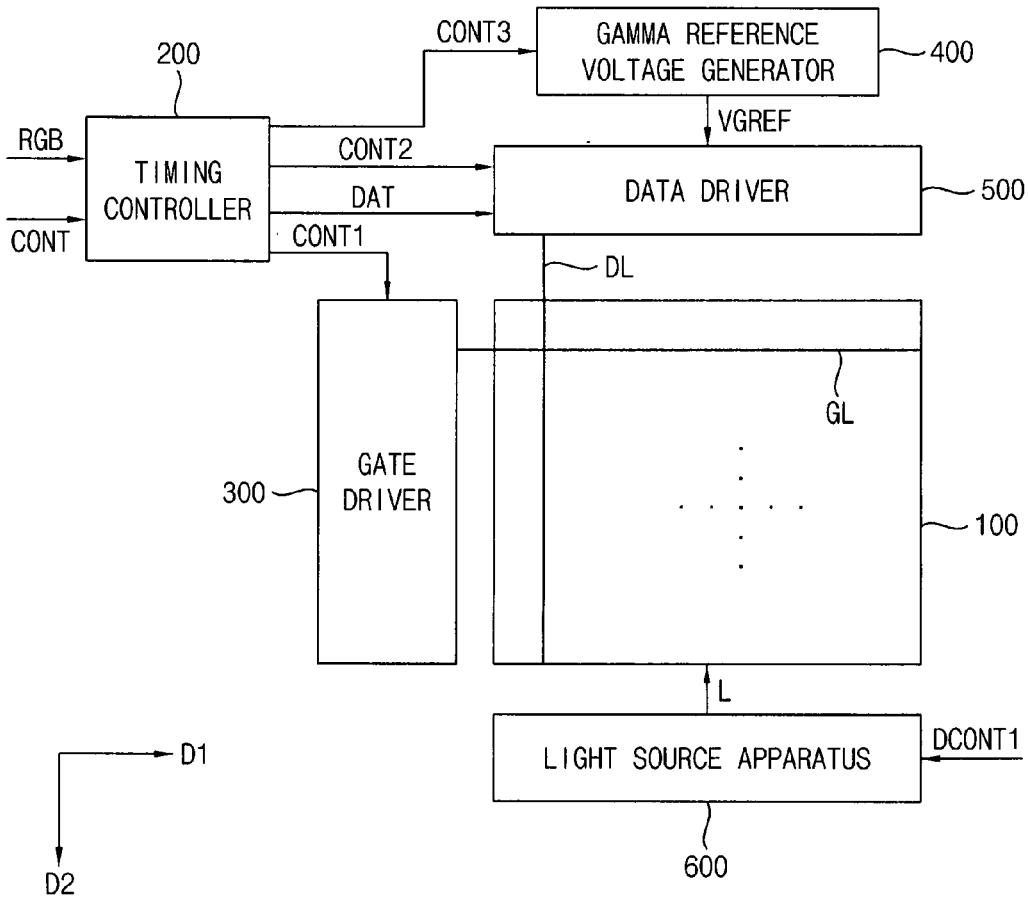
FIG. 1 is a block diagram illustrating a display apparatus according to exemplary embodiments.

Hereinafter, the invention will be explained in detail with reference to the accompanying drawings.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this invention will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/ or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an exemplary embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

FIG. 1 is a block diagram illustrating a display apparatus according to exemplary embodiments.

Referring to FIG. 1, the display apparatus includes a display panel 100 and a panel driver. The panel driver includes a timing controller 200, a gate driver 300, a gamma reference voltage generator 400, a data driver 500 and a light source apparatus 600.

The display panel 100 includes a display region for displaying an image and a peripheral region adjacent to the display region.

The display panel 100 includes a plurality of gate lines GL, a plurality of data lines DL and a plurality of pixels electrically connected to the gate lines GL and the data lines DL. The gate lines GL extend in a first direction D1 and the data lines DL extend in a second direction D2 crossing the first direction D1.

In exemplary embodiments, the pixels may include a switching element (not shown), a liquid crystal capacitor (not shown) and a storage capacitor (not shown). The liquid crystal capacitor and the storage capacitor may be electrically connected to the switching element. The pixels may be arranged in a matrix configuration.

The timing controller 200 receives input image data RGB and an input control signal CONT from an external device (not shown). In an exemplary embodiment, the input image data RGB may include red image data R, green image data G and blue image data B, for example. In an exemplary embodiment, the input control signal CONT may include a master clock signal and a data enable signal, for example. In an exemplary embodiment, the input control signal CONT may further include a vertical synchronizing signal and a horizontal synchronizing signal, for example.

The timing controller 200 generates a first control signal CONT1, a second control signal CONT2, a third control signal CONT3 and a data signal DAT based on the input image data RGB and the input control signal CONT.

The timing controller 200 generates the first control signal CONT1 for controlling operations of the gate driver 300 based on the input control signal CONT, and outputs the first control signal CONT1 to the gate driver 300. In an exemplary embodiment, the first control signal CONT1 may include a vertical start signal and a gate clock signal, for example.

The timing controller 200 generates the second control signal CONT2 for controlling operations of the data driver 500 based on the input control signal CONT, and outputs the second control signal CONT2 to the data driver 500. In an exemplary embodiment, the second control signal CONT2 may include a horizontal start signal and a load signal, for example.

The timing controller 200 generates the data signal DAT based on the input image data RGB. The timing controller 200 outputs the data signal DAT to the data driver 500.

The timing controller 200 generates the third control signal CONT3 for controlling operations of the gamma reference voltage generator 400 based on the input control signal CONT, and outputs the third control signal CONT3 to the gamma reference voltage generator 400.

The gate driver 300 generates gate signals for driving the gate lines GL in response to the first control signal CONT1 received from the timing controller 200. The gate driver 300 sequentially outputs the gate signals to the gate lines GL.

In exemplary embodiments, the gate driver 300 may be directly disposed (e.g., mounted) on the display panel 100, or may be connected to the display panel 100 as a tape carrier package ("TCP") type. In an alternative exemplary embodiment, the gate driver 300 may be integrated on the peripheral region of the display panel 100.

The gamma reference voltage generator 400 generates a gamma reference voltage VGREF in response to the third control signal CONT3 received from the timing controller 200. The gamma reference voltage generator 400 outputs the gamma reference voltage VGREF to the data driver 500. The level of the gamma reference voltage VGREF corresponds to grayscales of a plurality of pixel data included in the data signal DAT.

In exemplary embodiments, the gamma reference voltage generator 400 may be disposed in the timing controller 200, or may be disposed in the data driver 500.

The data driver 500 receives the second control signal CONT2 and the data signal DAT from the timing controller 200, and receives the gamma reference voltage VGREF from the gamma reference voltage generator 400. The data driver 500 converts the data signal DAT to data voltages having analogue levels based on the gamma reference voltage VGREF. The data driver 500 outputs the data voltages to the data lines DL.

In exemplary embodiments, the data driver 500 may be directly disposed (e.g., mounted) on the display panel 100, or may be connected to the display panel 100 as a TCP type. In an alternative exemplary embodiment, the data driver 500 may be integrated on the peripheral region of the display panel 100.

The light source apparatus 600 receives a first dimming control signal from the external device. The light source apparatus 600 is driven in a method of an analogue dimming. The light source apparatus 600 emits light L to the display panel 100 based on the first dimming control signal.

The light source apparatus 600 will be explained in detail with reference to FIGS. 2 through 10.

Figure 2:
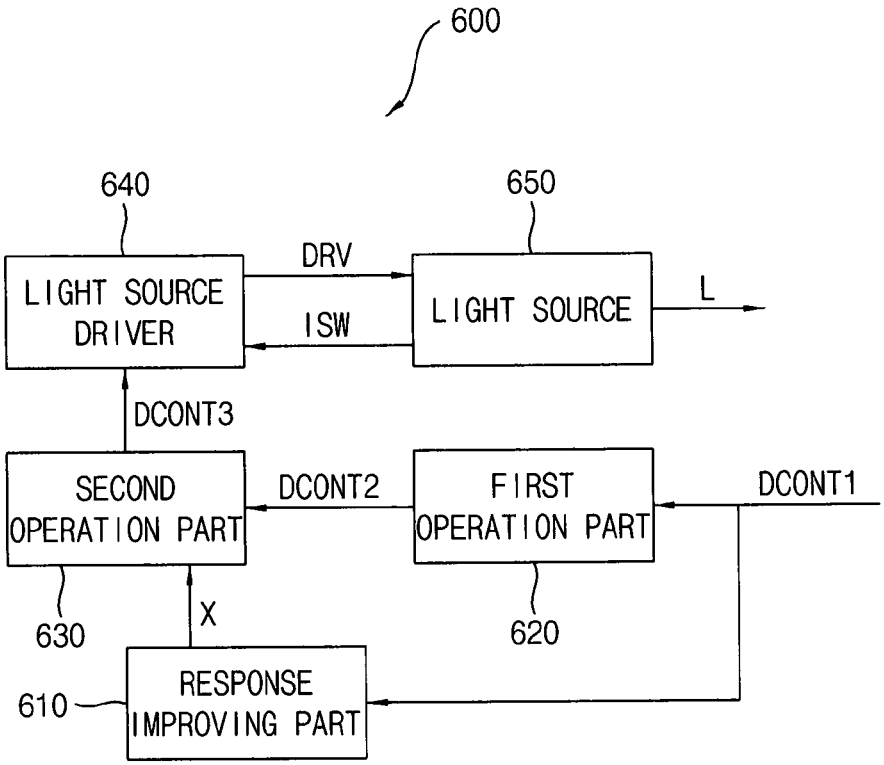
FIG. 2 is a block diagram illustrating a light source apparatus according to exemplary embodiments.

FIG. 2 is a block diagram illustrating a light source apparatus according to exemplary embodiments.

Referring to FIGS. 1 and 2, the light source apparatus 600 includes a response improving part 610, a first operation part 620, a second operation part 630, a light source driver 640 and a light source 650.

The response improving part 610 receives the first dimming control signal DCONT1 having a first rising period. The first dimming control signal DCONT1 may further have a first falling period. The response improving part 610 generates a response improving signal X based on the first dimming control signal DCONT1.

The response improving part 610 will be explained in detail with reference to FIGS. 3A through 3D.

The first operation part 620 receives the first dimming control signal DCONT1. The first operation part 620 generates a second dimming control signal DCONT2 having the first rising period based on the first dimming control signal DCONT1. The second dimming control signal DCONT2 may further have the first falling period.

The first operation part 620 will be explained in detail with reference to FIG. 5.

The second operation part 630 performs an arithmetic operation based on the second dimming control signal DCONT2 and the response improving signal X to generate a third dimming control signal DCONT3. The third dimming control signal DCONT3 has a second rising period shorter than the first rising period. The third dimming control signal DCONT3 may further have a second falling period shorter than the first falling period.

The second operation part 630 will be explained in detail with reference to FIG. 6.

The light source driver 640 receives the third dimming control signal DCONT3. The light source driver 640 generates a light source driving signal DRV based on the third dimming control signal DCONT3 to drive the light source 650. A duty ratio of the light source driving signal DRV may be set based on a level of the third dimming control signal DCONT3.

The light source driver 640 will be explained in detail with reference to FIG. 7.

The light source 650 emits light L. The light source 650 may include a plurality of light sources. In an exemplary embodiment, the light source 650 may include a plurality of light emitting diodes ("LEDs"), for example. The light source 650 may emit the light L to the display panel 100 based on the third dimming control signal DCONT3.

In exemplary embodiments, the light source 650 may include just a single LED string. The light source apparatus 600 may be an edge type lighting apparatus. The light source 650 may be disposed corresponding to a single side of the display panel 100. In an exemplary embodiment, the light source 650 may be disposed corresponding to a shorter side of the display panel 100. In an alternative exemplary embodiment, the light source 650 may be disposed corresponding to a longer side of the display panel 100. The light source apparatus 600 may further include a light guide plate configured for guiding the light generated from the light source 650 to the display panel 100. The light guide plate may include a rectangular parallelepiped shape. The light guide plate may include a wedge shape in a cross-sectional view.

The light source 650 will be explained in detail with reference to FIG. 9.

The response improving signal X, the second and third dimming control signals DCONT2, DCONT3 and the light source driving signal DRV will be explained in detail with reference to FIGS. 4 through 8.

FIGS. 3A through 3D are circuit diagrams illustrating examples of a response improving part included in a light source apparatus according to exemplary embodiments.

Figure 3A:
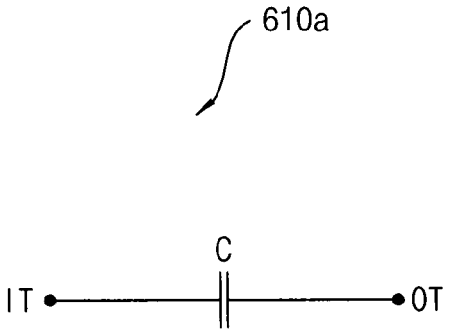
FIGS. 3A through 3D are circuit diagrams illustrating examples of a response improving part included in a light source apparatus according to exemplary embodiments.

Referring to FIGS. 2 and 3A, a response improving part 610*a* may include a capacitor C including first and second electrodes. The first electrode of the capacitor C may be connected to an input terminal IT of the response improving part 610*a*. The first electrode of the capacitor C may be directly or indirectly connected to the input terminal IT of the response improving part 610*a*. The first dimming control signal DCONT1 may be applied to the first electrode of the capacitor C. The second electrode of the capacitor C may be connected to an output terminal OT of the response improving part 610*a*. The second electrode of the capacitor C may be directly or indirectly connected to the output terminal OT of the response improving part 610*a*. The capacitor C may generate the response improving signal X based on the first dimming control signal DCONT1.

Figure 3B:
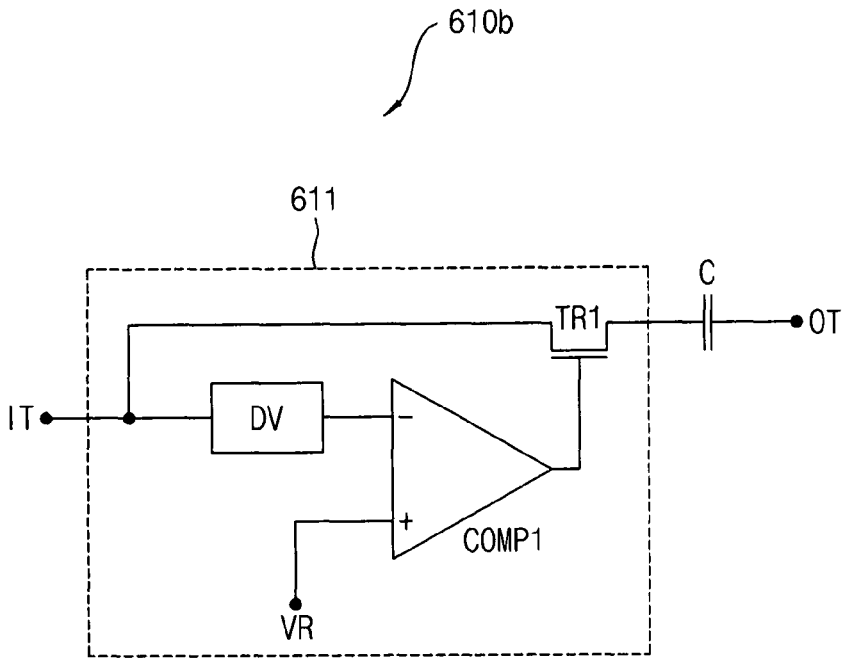

Referring to FIGS. 2 and 3B, a response improving part 610*b* may include the capacitor C and a comparator 611. Hereinafter, any repetitive explanation concerning FIG. 3A will be omitted.

The comparator 611 may include a first comparator COMP1 and a first transistor TR1. The first comparator COMP1 may include a first input terminal, a second input terminal and an output terminal. The first input terminal of the first comparator COMP1 may receive a voltage variation DV of the first dimming control signal DCONT1. The second input terminal of the first comparator COMP1 may receive a reference variation VR. The output terminal of the first comparator COMP1 may be connected to a gate electrode of the first transistor TR1. The first transistor TR1 may be connected between an input terminal IT of the response improving part 610*b* and the first electrode of the capacitor C.

The first comparator COMP1 may compare the voltage variation DV and the reference variation VR. The first comparator COMP1 may output a turn-on voltage of the first transistor TR1 to the output terminal of the first comparator COMP1 when the voltage variation DV is greater than the reference variation VR. In this case, the first transistor TR1 may deliver the first dimming control signal DCONT1 received from the input terminal IT of the response improving part 610*b* to the capacitor C. The first comparator COMP1 may output a turn-off voltage of the first transistor TR1 to the output terminal of the first comparator COMP1 when the voltage variation DV is smaller than or same as the reference variation VR.

According to the exemplary embodiment, the response improving part 610*b* operates only when the voltage variation DV is greater than the reference variation VR.

Figure 3C:
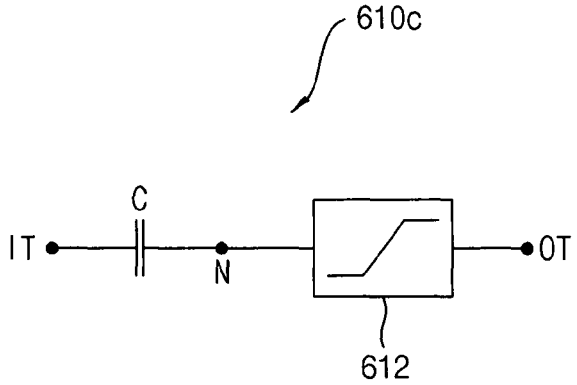

Referring to FIGS. 2 and 3C, a response improving part 610*c* may include the capacitor C and a voltage limiter 612. Hereinafter, any repetitive explanation concerning FIG. 3A will be omitted.

The voltage limiter 612 may be connected between the second electrode of the capacitor C and an output terminal OT of the response improving part 610*c*. The voltage limiter 612 may set upper and lower limits of the response improving signal X.

The operation of the voltage limiter 612 will be explained in detail with reference to FIG. 4.

Figure 3D:
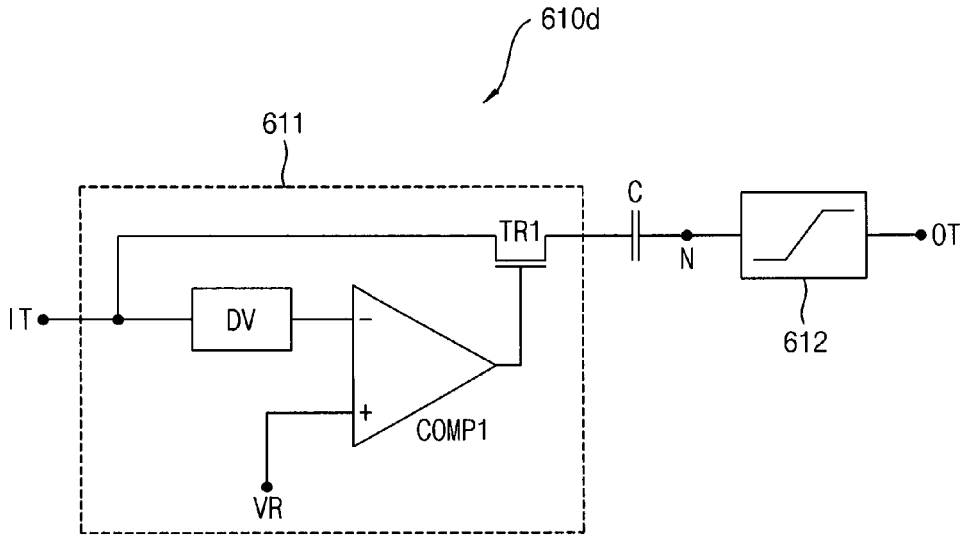

Referring to FIGS. 2 and 3D, a response improving part 610*d* may include the capacitor C, the comparator 611 and the voltage limiter 612. Hereinafter, any repetitive explanation concerning FIGS. 3A through 3C will be omitted.

Figure 4:
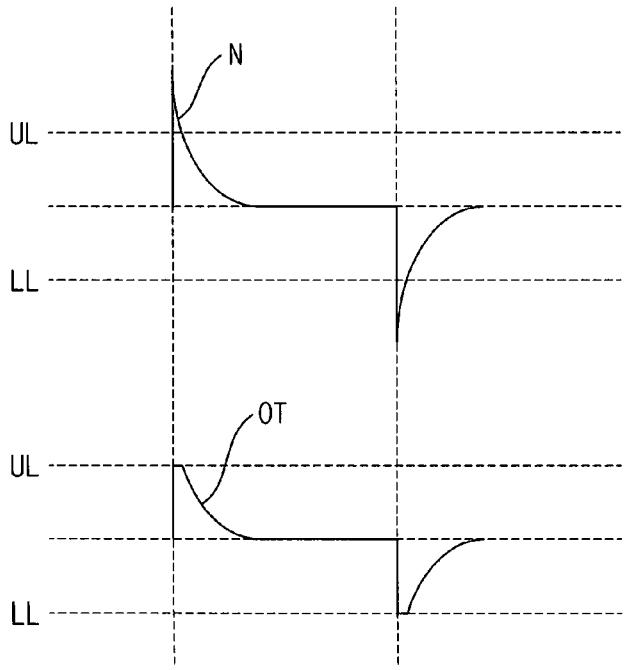
FIG. 4 is a diagram illustrating voltages of node N and node OT in FIGS. 3C and 3D.

FIG. 4 is a diagram illustrating voltages of node N and node OT in FIGS. 3C and 3D.

Referring to FIGS. 3C, 3D and 4, a voltage without an upper limit UL and a lower limit LL is detected at node N of the response improving part 610*c*, 610*d*. A voltage with the upper limit UL and the lower limit LL is detected at node OT of the response improving part 610*c*, 610*d*. The voltage detected at the node OT may be the response improving signal X (refer to FIG. 2).

Figure 5:
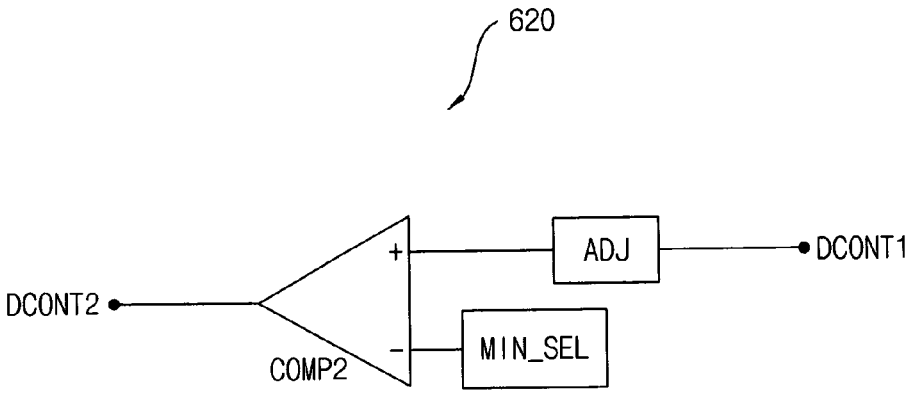
FIG. 5 is a circuit diagram illustrating a first operation part included in a light source apparatus according to exemplary embodiments.

FIG. 5 is a circuit diagram illustrating a first operation part included in a light source apparatus according to exemplary embodiments.

Referring to FIGS. 2 and 5, the first operation part 620 may include an adjustment part ADJ, a minimum value selector MIN_SEL and a second comparator COMP2.

The adjustment part ADJ may be connected to a first input terminal of the second comparator COMP2. The adjustment part ADJ may set upper and lower limits of the first dimming control signal DCONT1, and may adjust a level of the first dimming control signal DCONT1.

The minimum value selector MIN_SEL may be connected to a second input terminal of the second comparator COMP2.

The second comparator COMP2 may output the second dimming control signal DCONT2 to the second operation part 630. The first and second dimming control signals DCONT1, DCONT2 may have the first rising period and the first falling period.

Figure 6:
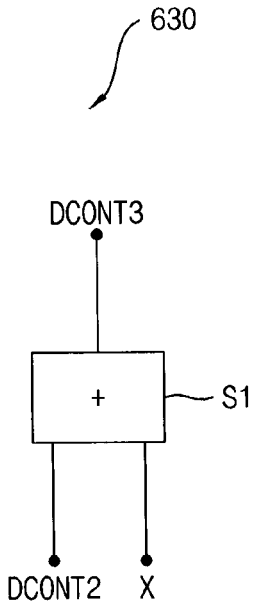
FIG. 6 is a circuit diagram illustrating a second operation part included in a light source apparatus according to exemplary embodiments.

FIG. 6 is a circuit diagram illustrating a second operation part included in a light source apparatus according to exemplary embodiments.

Referring to FIGS. 2 and 6, the second operation part 630 may include a first adder S1. A first input terminal of the first adder S1 may receive the second dimming control signal DCONT2. A second input terminal of the first adder S1 may receive the response improving signal X. The first adder S1 may add the second dimming control signal DCONT2 to the response improving signal X to generate the third dimming control signal DCONT3 and may output the third dimming control signal DCONT3 to the light source driver 640.

Figure 7:
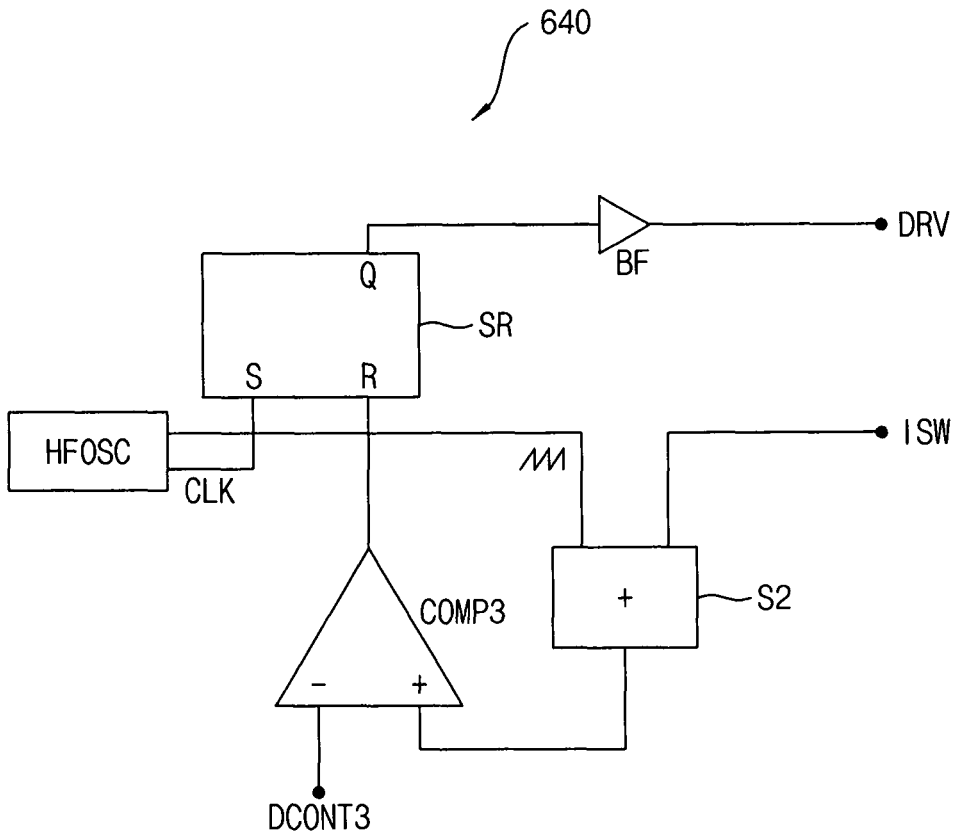
FIG. 7 is a circuit diagram illustrating a light source driver included in a light source apparatus according to exemplary embodiments.

FIG. 7 is a circuit diagram illustrating a light source driver included in a light source apparatus according to exemplary embodiments.

Referring to FIGS. 2 and 7, the light source driver 640 may include a third comparator COMP3, a second adder S2, a high frequency oscillator HFOSC, an SR latch SR and a buffer BF.

A first input terminal of the third comparator COMP3 may receive the third dimming control signal DCONT3. A second input terminal of the third comparator COMP3 may be connected to an output terminal of the second adder S2. An output terminal of the third comparator COMP3 may be connected to a reset terminal R of the SR latch SR.

A first input terminal of the second adder S2 may receive a light source voltage ISW from the light source 650. A second input terminal of the second adder S2 may receive a high frequency signal from the high frequency oscillator HFOSC. The second adder S2 may add the light source voltage ISW to the high frequency signal to output the result to the second input terminal of the third comparator COMP3.

A set terminal S of the SR latch SR may receive a clock signal CLK from the high frequency oscillator HFOSC. An output terminal Q of the SR latch SR may be connected to an input terminal of the buffer BF.

An output terminal of the buffer BF may be connected to the light source 650. The buffer BF may output the light source driving signal DRV to the light source 650.

Figure 8:
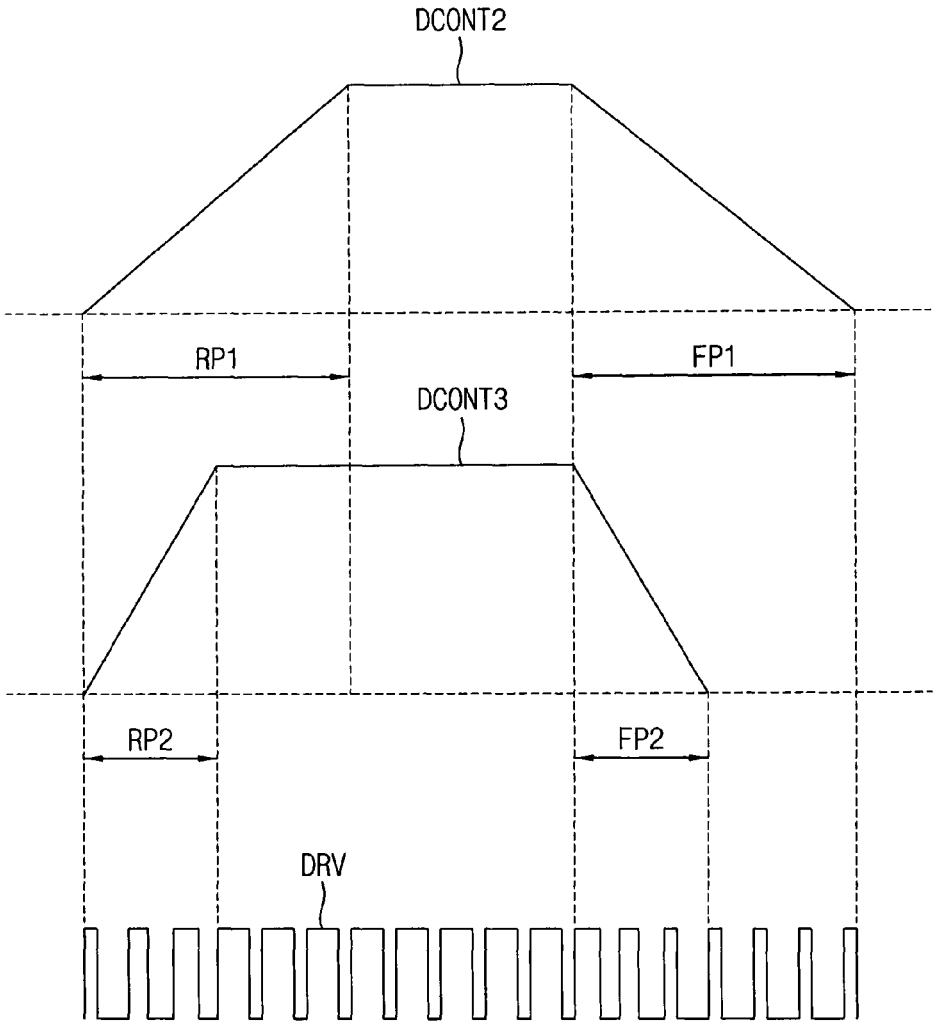
FIG. 8 is a diagram illustrating several signals of a light source apparatus according to exemplary embodiments.

FIG. 8 is a diagram illustrating several signals of a light source apparatus according to exemplary embodiments.

Referring to FIGS. 2 and 8, the second dimming control signal DCONT2 has a first rising period RP1 and a first falling period FP1.

The response improving part 610 generates the response improving signal X to improve a response of the second dimming control signal DCONT2. The response improving signal X may have a positive voltage during the first rising period RP1. The response improving signal X may have a negative voltage during the first falling period FP1. In an exemplary embodiment, the response improving signal X may be substantially the same as the voltage detected at the node OT in FIG. 4, for example.

The second operation part 630 performs an arithmetic operation based on the second dimming control signal DCONT2 and the response improving signal X to generate the third dimming control signal DCONT3. In an exemplary embodiment, the second operation part 630 may add the second dimming control signal DCONT2 to the response improving signal X to generate the third dimming control signal DCONT3, for example. The third dimming control signal DCONT3 has a second rising period RP2 and a second falling period FP2. The second rising period RP2 is shorter than the first rising period RP1. The second falling period FP2 is shorter than the first falling period FN.

The light source driver 640 generates the light source driving signal DRV based on the third dimming control signal DCONT3. A duty ratio of the light source driving signal DRV may be set based on a level of the third dimming control signal DCONT3. In an exemplary embodiment, the duty ratio of the light source driving signal DRV may increase as the level of the third dimming control signal DCONT3 increases, for example. The duty ratio of the light source driving signal DRV may decrease as the level of the third dimming control signal DCONT3 decreases. The duty ratio of the light source driving signal DRV may increase as time goes by during the second rising period RP2. The duty ratio of the light source driving signal DRV may be constant during a high period of the third dimming control signal DCONT3. The duty ratio of the light source driving signal DRV may decrease as time goes by during the second falling period FP2. The light source driver 640 outputs the light source driving signal DRV to the light source 650.

Figure 9:
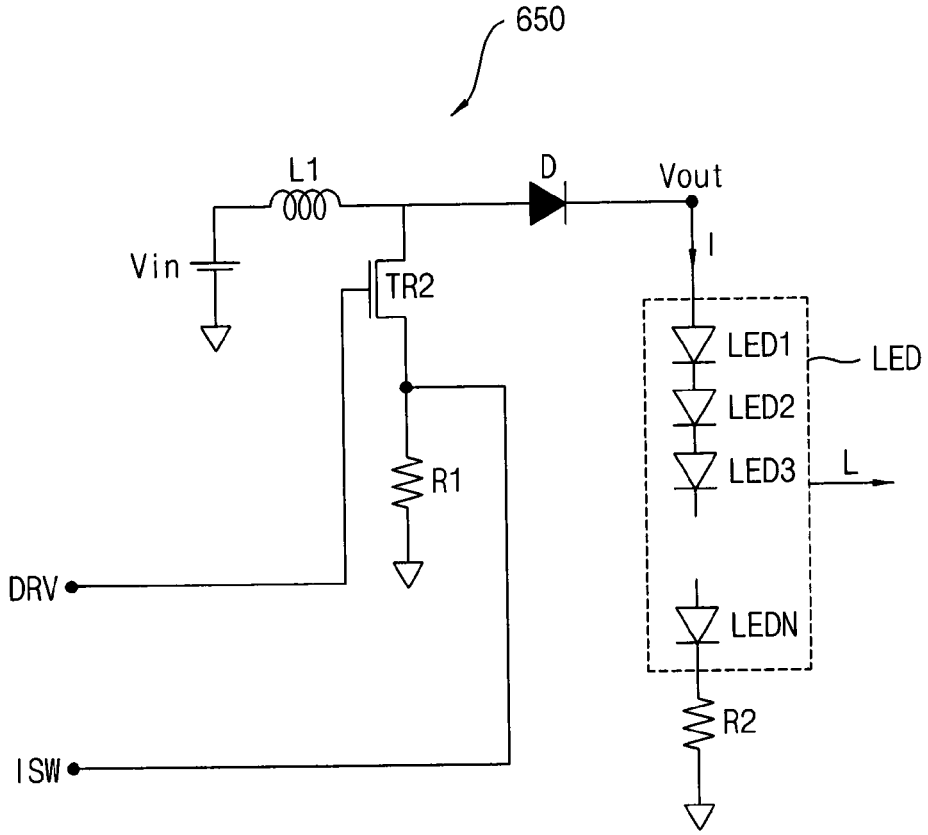
FIG. 9 is a circuit diagram illustrating a light source included in a light source apparatus according to exemplary embodiments.

FIG. 9 is a circuit diagram illustrating a light source included in a light source apparatus according to exemplary embodiments.

Referring to FIGS. 2 and 9, the light source 650 may include an input power source vin, an inductor L1, a second transistor TR2, a first resistor R1, a diode D, a light emitting diode LED and a second resistor R2.

One end of the inductor L1 may receive the input power Vin. The other end of the inductor L1 may be connected to a first electrode of the second transistor TR2 and an input terminal of the diode D.

A gate electrode of the second transistor TR2 may receive the light source driving signal DRV. A second electrode of the second transistor TR2 may be connected to one end of the first resistor R1. The other end of the first resistor R1 may be grounded. The light source voltage ISW may be a voltage of the second electrode of the second transistor TR2.

An output terminal of the diode D may be connected to an input terminal of the light emitting diode LED. The light emitting diode LED may include first through N-th light emitting diodes LED1~LEDN. The light emitting diode LED emits the light L when a current I flows through the light emitting diode LED. The light emitting diode LED emits the light L to the display panel 100 (refer to FIG. 1). An output terminal of the light emitting diode LED may be connected to one end of the second resistor R2. The other end of the second resistor R2 may be grounded.

The current I flows through the light emitting diode LED when the light source driving signal DRV turns on the second transistor TR2.

According to the exemplary embodiment, the third dimming control signal DCONT3 having a faster response speed than the second dimming control signal DCONT2 is generated based on the response improving signal X. Thus, a response speed of the light source driving signal DRV becomes higher, and a response speed of the current I becomes higher. As a result, a response speed of the light source apparatus 600 is improved.

Figure 10:
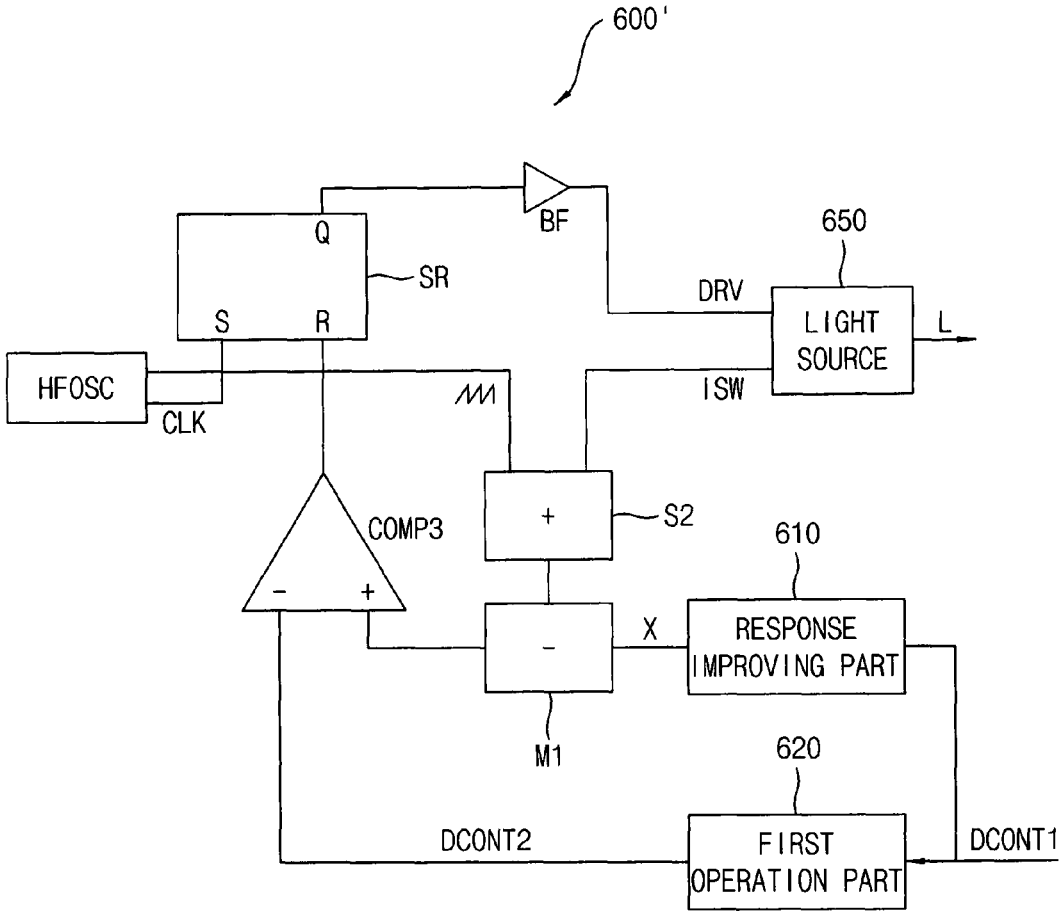
FIG. 10 is a block diagram illustrating a light source apparatus according to exemplary embodiments.

FIG. 10 is a block diagram illustrating a light source apparatus according to exemplary embodiments. Hereinafter, any repetitive explanation concerning FIGS. 2 through 9 will be omitted.

Referring to FIG. 10, a light source apparatus 600' includes a response improving part 610, a first operation part 620 and a light source 650. The light source apparatus 600' may further include a third comparator COMP3, a second adder S2, a high frequency oscillator HFOSC, an SR latch SR and a buffer BF. The light source apparatus 600' may further include a subtractor M1.

The response improving part 610 generates a response improving signal X based on the first dimming control signal DCONT1. The response improving part 610 may output the response improving signal X to a first input terminal of the subtractor M1.

The first operation part 620 generates a second dimming control signal DCONT2 having a first rising period based on the first dimming control signal DCONT1 having the first rising period. The first operation part 620 may output the second dimming control signal DCONT2 to a first input terminal of the third comparator COMP3.

A first input terminal of the second adder S2 may receive a light source voltage ISW from the light source 650. A second input terminal of the second adder S2 may receive a high frequency signal from the high frequency oscillator HFOSC. The second adder S2 may add the light source voltage ISW to the high frequency signal to output the result to a second input terminal of the subtractor M1.

The subtractor M1 may subtract the response improving signal X from the output of the second adder S2 to output the result to a second input terminal of the third comparator COMP3.

An output terminal of the third comparator COMP3 may be connected to a reset terminal R of the SR latch SR.

A set terminal S of the SR latch SR may receive a clock signal CLK from the high frequency oscillator HFOSC. An output terminal Q of the SR latch SR may be connected to an input terminal of the buffer BF.

An output terminal of the buffer BF may be connected to the light source 650. The buffer BF may output the light source driving signal DRV to the light source 650.

According to the exemplary embodiment, the same effect can be obtained by using the subtractor M1.

The above described exemplary embodiments may be used in a display apparatus and/or a system including the display apparatus, such as a mobile phone, a smart phone, a PDA, a PMP, a digital camera, a digital television, a set-top box, a music player, a portable game console, a navigation device, a personal computer ("PC"), a server computer, a workstation, a tablet computer, a laptop computer, a smart card, a printer, etc., for example.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A light source apparatus comprising:

a light source which emits light;

a response improving part which generates a response improving signal based on a first dimming control signal having a first rising period;

a first operation part which generates a second dimming control signal based on the first dimming control signal, the second dimming control signal having the first rising period;

a second operation part which generates a third dimming control signal by performing an arithmetic operation based on the second dimming control signal and the response improving signal, the third dimming control signal having a second rising period shorter than the first rising period; and a light source driver which generates a light source driving signal based on the third dimming control signal and drives the light source based on the light source driving signal.

2. The light source apparatus of claim 1, wherein each of the first and second dimming control signals has a first falling period, and the third dimming control signal has a second falling period shorter than the first falling period.

3. The light source apparatus of claim 2, wherein the response improving signal has a positive voltage during the first rising period, and has a negative voltage during the first falling period.

4. The light source apparatus of claim 1, wherein the response improving part comprises a capacitor comprising a first electrode connected to an input terminal of the response improving part and a second electrode connected to an output terminal of the response improving part, the input terminal of the response improving part receiving the first dimming control signal.

5. The light source apparatus of claim 4, wherein the response improving part further comprises a comparison part which delivers the first dimming control signal to the capacitor only when a voltage variation of the first dimming control signal during the first rising period is greater than a reference variation.

6. The light source apparatus of claim 5, wherein the comparison part comprises:

a comparator comprising a first input terminal which receives the voltage variation, a second input terminal which receives the reference variation, and a comparator output terminal; and a switching element connected between the input terminal of the response improving part and the first electrode of the capacitor, and comprising a gate electrode connected to the comparator output terminal.

7. The light source apparatus of claim 4, wherein the response improving part further comprises a voltage limiter which sets upper and lower limits of the response improving signal, and connected between the second electrode of the capacitor and the output terminal of the response improving part.

8. The light source apparatus of claim 1, wherein the second operation part adds the second dimming control signal to the response improving signal and generates the third dimming control signal.

9. The light source apparatus of claim 1, wherein a duty ratio of the light source driving signal is set based on a level of the third dimming control signal.

10. A display apparatus comprising:

a display panel which displays an image; and a light source apparatus comprising:

a light source which emits light to the display panel;

a response improving part which generates a response improving signal based on a first dimming control signal having a first rising period;

a first operation part which generates a second dimming control signal based on the first dimming control signal, the second dimming control signal having the first rising period;

a second operation part which generates a third dimming control signal by performing an arithmetic operation based on the second dimming control signal and the response improving signal, the third dimming control signal having a second rising period shorter than the first rising period; and a light source driver which generates a light source driving signal based on the third dimming control signal and drives the light source based on the light source driving signal.

11. The display apparatus of claim 10, wherein each of the first and second dimming control signals has a first falling period, and the third dimming control signal has a second falling period shorter than the first falling period.

12. The display apparatus of claim 11, wherein the response improving signal has a positive voltage during the first rising period, and has a negative voltage during the first falling period.

13. The display apparatus of claim 10, wherein the response improving part comprises a capacitor comprising a first electrode connected to an input terminal of the response improving part and a second electrode connected to an output terminal of the response improving part, the input terminal of the response improving part receiving the first dimming control signal.

14. The display apparatus of claim 13, wherein the response improving part further comprises a comparison part which delivers the first dimming control signal to the capacitor only when a voltage variation of the first dimming control signal during the first rising period is greater than a reference variation.

15. The display apparatus of claim 14, wherein the comparison part comprises:

a comparator comprising a first input terminal which receives the voltage variation, a second input terminal which receives the reference variation, and a comparator output terminal; and a switching element connected between the input terminal of the response improving part and the first electrode of the capacitor, and comprising a gate electrode connected to the comparator output terminal.

16. The display apparatus of claim 13, wherein the response improving part further comprises a voltage limiter which sets upper and lower limits of the response improving signal, and connected between the second electrode of the capacitor and the output terminal of the response improving part.

17. The display apparatus of claim 10, wherein the second operation part adds the second dimming control signal to the response improving signal and generates the third dimming control signal.

18. The display apparatus of claim 10, wherein a duty ratio of the light source driving signal is set based on a level of the third dimming control signal.

19. A method of driving a light source apparatus, the method comprising:

generating a response improving signal based on a first dimming control signal having a first rising period;

generating a second dimming control signal based on the first dimming control signal, the second dimming control signal having the first rising period;

generating a third dimming control signal by performing an arithmetic operation based on the second dimming control signal and the response improving signal, the third dimming control signal having a second rising period shorter than the first rising period;

generating a light source driving signal based on the third dimming control signal; and emitting light based on the light source driving signal.

20. The method of claim 19, wherein generating the third dimming control signal comprises:

adding the second dimming control signal to the response improving signal.

* * * * *